United States Patent [19]

Bessinger et al.

[11] Patent Number: 4,615,095

[45] Date of Patent: Oct. 7, 1986

[54] INCLINED DRAWER SLIDE INCORPORATING SCALE

[75] Inventors: Walter L. Bessinger, Grand Haven; Keith A. Hoffman, Hudsonville, both of Mich.

[73] Assignee: Knape & Vogt Manufacturing Company, Grand Rapids, Mich.

[21] Appl. No.: 788,384

[22] Filed: Oct. 17, 1985

Related U.S. Application Data

[63] Continuation of Ser. No. 576,569, Feb. 3, 1984, abandoned.

[51] Int. Cl.[4] ..... B23Q 17/00; A47B 88/00

[52] U.S. Cl. ..... 29/407; 312/333

[58] Field of Search ..... 312/333, 350, 341 NR; 308/3.6, 3.8; 29/407; 33/180 R, DIG. 10, DIG. 12, 333, 343

[56] References Cited

U.S. PATENT DOCUMENTS

| | | | |
|---|---|---|---|
| 1,850,616 | 3/1932 | Barnett | 33/DIG. 10 |
| 2,209,727 | 7/1940 | Gibson | 292/36 |
| 2,328,835 | 9/1943 | Motter | 45/77 |
| 2,496,673 | 2/1950 | Nielsen | 45/77 |
| 3,104,142 | 9/1963 | Knape et al. | 312/333 |
| 3,139,313 | 6/1964 | Rule | 312/333 |
| 3,243,247 | 3/1966 | Knape | 312/333 |
| 3,574,437 | 4/1971 | Stein et al. | 312/241 |
| 3,697,140 | 10/1972 | Livingston | 308/3.8 |
| 3,716,279 | 2/1973 | Anderson et al. | 308/3.8 |
| 3,954,315 | 5/1976 | Sanden | 312/333 |
| 3,973,814 | 8/1976 | Entrikin | 312/333 |

*Primary Examiner*—Howard N. Goldberg
*Assistant Examiner*—Steven Nichols
*Attorney, Agent, or Firm*—Price, Heneveld, Huizenga & Cooper

[57] ABSTRACT

The specification discloses an improved self-closing drawer slide including integral scales to facilitate installation. More particularly, separate scales are provided on the cabinet channel assembly and the drawer channel assembly, and each scale indicates the height to which one end of the channel assembly must be elevated above the other end of the channel assembly to mount the channel at a desired inclination from horizontal.

12 Claims, 11 Drawing Figures

INCLINED DRAWER SLIDE INCORPORATING SCALE

This is a continuation of application Ser. No. 576,569, filed Feb. 3, 1984, now abandoned.

BACKGROUND OF THE INVENTION

The present invention relates to drawer slides, and more particularly to self-closing drawer slides.

A variety of self-closing drawer slides have been developed to slidably support a drawer box within a cabinet. A drawer box mounted on a self-closing slide is preferably drawn by gravity into the cabinet when released.

Types of self-closing slides include "straight incline" and "bent channel". The straight incline type of slide includes straight cabinet and drawer channels mounted on the cabinet and drawer box, respectively, at a common angle inclined from the horizontal. In the bent channel type of slide, the cabinet channel and drawer channel are both bent partway along their lengths to each include a horizontal portion and an inclined portion.

The closing characteristics of a self-closing slide are affected by a plurality of parameters including the inclination of the channels, the drawer weight, and the location of the drawer weight within the drawer box. If the inclination of the channels is too steep, (1) the drawer closes too quickly, slamming within the cabinet, and (2) the drawer requires excessive vertical clearance within the cabinet opening. If the channel inclination is too shallow, the drawer will not return into the cabinet when released. Therefore, the angle at which the channels are mounted on the cabinet and drawer is important to the proper operation of the slide.

Installation of known self-closing slides is relatively time consuming and subject to error. First, mounting the cabinet and drawer rails at a common angle is relatively difficult because the two rails are mounted on different objects and are not readily compared visually. If the angles are not the same, the drawer will not be supported horizontally within the cabinet opening and will have an unacceptable appearance and/or operation. Second, measuring the proper distance at which one end of the rail is to be elevated above the other also is relatively difficult, subject to error, and requires measuring devices. Because of the calculations and measurements normally required, installation of the channels is at least occasionally incorrect requiring remounting or resulting in improper operation.

At least two prior artisans have attempted to alleviate the problems associated with properly mounting a drawer slide at a desired angular orientation. One such construction includes a horizontal slot in the side of the drawer box and a channel mounted thereon including a plurality of indexing tabs extending into the slot. An example of this construction is illustrated in U.S. Pat. No. 3,973,814, entitled DRAWER SLIDE ASSEMBLY FOR SELF-CLOSING DRAWER, issued Aug. 10, 1976, to Entrikin. However, this construction is relatively complicated, being both time-consuming and labor intensive to manufacture. Second, this construction does not provide any structure for properly orienting the cabinet portion of the slide assembly.

A second construction includes an indexing tab extending downwardly from the forward end of the cabinet rail. The channel is properly oriented by positioning the rear channel end and the bottom edge of the indexing tab on a common horizontal line. An example of this construction is illustrated in U.S. Pat. No. 3,243,247, entitled SELF-CLOSING DRAWER SLIDE, issued Mar. 29, 1966, to Knape. However, this construction requires additional manufacturing steps to form the indexing tab. Additionally, different height indexing tabs are required for different length channels having different bend points. Third, the indexing tab can catch on objects (if improperly handled), most notably the forward portion of the cabinet and cause undesirable marking of the cabinet face.

SUMMARY OF THE INVENTION

The aforementioned problems are solved by the present invention wherein a self-closing drawer slide includes integral scales on both the cabinet channel assembly and the drawer channel assembly to facilitate installation of the slide at a desired inclination. More particularly, each scale indicates the distance to which one end of the respective channel assembly must be elevated above the other end to provide the desired angular orientation of the channel on the cabinet or drawer box. The channels are accurately, easily, and quickly installed by making a reference mark on the cabinet or drawer box using the integral scales and elevating one channel end until it properly registers with the mark to provide the desired mounting angle.

In a preferred embodiment of the invention, the drawer slide includes a cabinet channel assembly having a generally elongated rail and a roller bracket extending upwardly therefrom. A linear scale is stamped in the roller bracket and extends generally perpendicularly from the rail. The channel assembly is installed in the cabinet by making a mark on the cabinet aligned with a reference mark on the scale. The forward end of the assembly is then elevated until a second mark on the scale registers with the mark on the cabinet; and the cabinet assembly is secured in position. The drawer channel assembly also includes a generally elongated rail and a roller bracket extending downwardly therefrom and including a second scale. The drawer assembly is installed by inverting the drawer channel assembly and aligning the rail edge opposite the roller bracket with the lower edge of the drawer box. A mark is made on the drawer box corresponding to a mark on the scale. The drawer channel assembly is then reinverted to its proper position; the roller bracket is aligned with the lower edge of the drawer box; the lower edge of the drawer rail is aligned with the mark on the drawer box; and the channel assembly is secured in position.

The objects, advantages, and features of the invention will be more readily understood and appreciated by reference to the detailed description of the preferred embodiment and the drawings.

DETAILED DESCRIPTION OF THE PREFERRED EMBODIMENT

Figure 1:
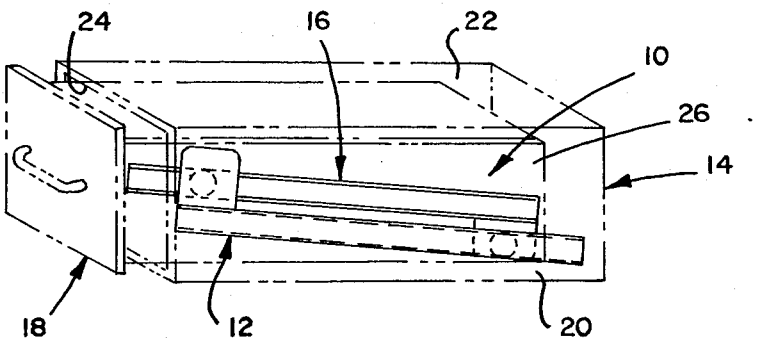
FIG. 1 is a perspective view of the self-closing drawer slide of the present invention installed on a cabinet and drawer box shown in phantom.

A drawer slide constructed in accordance with a preferred embodiment of the invention is illustrated in the drawings and generally designated 10. The drawer slide (FIG. 1) includes cabinet channel assembly 12 mounted within cabinet 14 and drawer channel assembly 16 mounted on drawer box 18. The cabinet and drawer channel assemblies slidingly interfit to slidably support drawer box 18 within cabinet 14. Both of assemblies 12 and 16 are inclined at a common angle from the horizontal such that drawer box 18 is self-closing.

Cabinet 14 and drawer box 18 are generally well-known to those having ordinary skill in the art. Suffice it to say that cabinet 14 includes a pair of opposite sides 20 and 22, each of which supports one of cabinet channel assemblies 12, and defines cabinet opening 24 at the forward end thereof. Similarly, drawer box 18 includes a pair of opposite sides 26 and 28, each of which supports one of drawer channel assemblies 16. Each of sides 26 and 28 includes a lower edge **26*a* and 28*a***, respectively.

Figure 3:
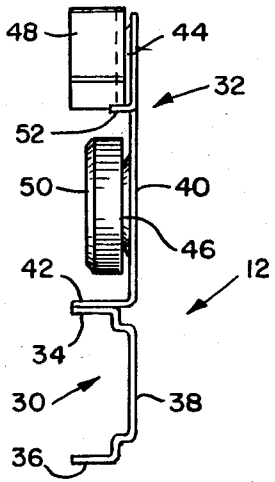
FIG. 3 is an end elevational view of the right cabinet channel assembly.
Figure 2:
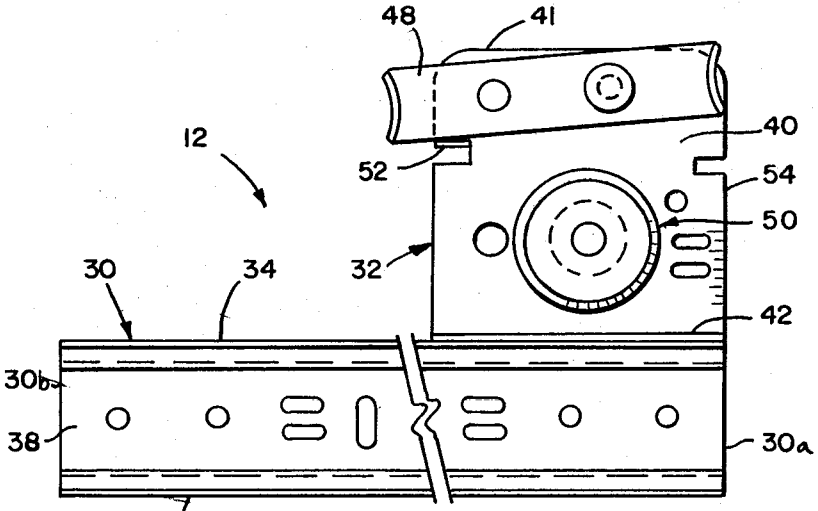
FIG. 2 is a fragmentary side elevational view of the right cabinet channel assembly.

Cabinet channel assembly 12 (FIGS. 2 and 3) generally comprises drawer channel 30 and drawer roller bracket 32. Channel 30 is straight or linear throughout its length between its forward and rear ends **30*a* and 30*b* and has a generally C-shaped cross section including upper flange 34, lower flange 36, and interconnecting web portion 38. Channel 30 can have any one of a plurality of lengths and in the preferred embodiment is 12, 14, 16, 18, 20, 22, 24, 26, or 28 inches long. Roller bracket 32 is generally L-shaped in cross section including generally planar body 40, having top edge 41, and linear securing flange 42 extending generally perpendicularly therefrom. Securing flange 42 abuts upper flange 34 of channel 30 and is welded thereto to rigidly interconnect the channel and roller bracket 32. Body 40 defines a pair of raised circular bosses 44 and 46 defining apertures 44*a* and 46*a*, respectively. Stop lever 48 and roller 50, both well-known to those having ordinary skill in the art, are pivotally supported on rivets secured within apertures 44*a* and 46*a*, respectively. Tab 52 integral with body 40 is bent outwardly therefrom in a direction common with securing flange 42 to provide a catch for stop lever 48**.

Figure 2A:
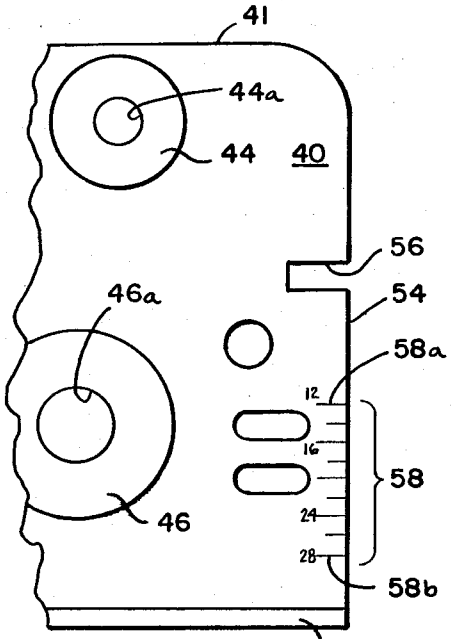
FIG. 2A is an enlarged fragmentary side elevational view of the right cabinet channel roller plate and scale thereon.

Cabinet roller plate 40 defines a generally linear forward edge 54 (FIGS. 2 and 2A) generally aligned with the forward edge **30*a* of channel 38. Notch or reference point 56 is formed in body 40 through straight edge 54 and is located approximately 40 percent of the distance from top edge 41 to securing flange 42. Marks 58 are scribed or stamped into body 40 and define desired distances between reference notch 56 and each of the marks. The uppermost mark 58*a* includes an annotation numeral "12", while the lowermost mark 58*b* includes an annotation numeral "28". The remaining marks extending between marks 58*a* and 58*b* correspond to increments of two so that one mark is provided for each of the numerals 12, 14, 16, 18, 20, 22, 24, 26, and 28. Each of marks 58 corresponds to one of the possible lengths of channel 30. The distance between reference notch 56 and mark 58*a* is used in installing a 12-inch cabinet channel, while the distance between reference notch 56 and mark 58*b* is utilized in installing a 28-inch cabinet channel. The remaining marks 58 extending between marks 58*a* and 58*b* corresponding to cabinet channels of the indicated lengths. The actual distance between marks 58*a* and 58*b* is one-half inch, and the remainder of marks 58** are evenly spaced therebetween.

Figure 5:
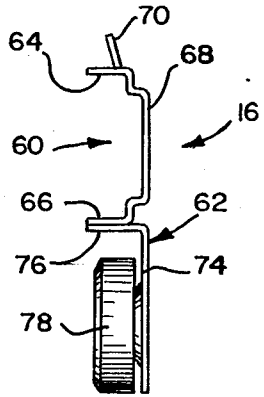
FIG. 5 is an end elevational view of the right drawer channel assembly.
Figure 4:
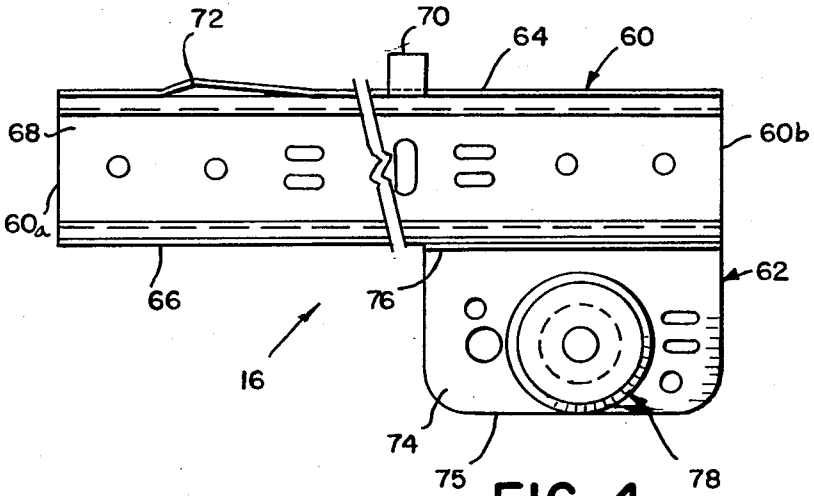
FIG. 4 is a fragmentary side elevational view of the right drawer channel assembly.

Drawer channel assembly 16 (FIGS. 4 and 5) generally comprises straight channel 60 and roller bracket 62 secured thereto. Channel 60 includes forward and rear ends **60*a* and 60*b* and has a C-shaped cross section including upper flange 64, lower flange 66, and web portion 68 extending thereetween. Channel 60 can have any one of a plurality of lengths and in the preferred embodiment, a length of 12, 14, 16, 18, 20, 22, 24, 26, or 28 inches. Typically, the length of channel 60 will match the length of cabinet channel 30 in any particular installation. Integral stop tab 70 is bent from and extends upwardly from upper flange 64 to cooperate with stop lever 48 (see FIG. 2) when assemblies 12 and 16 are slidingly interfitted to prevent drawer box 14 from being inadvertently drawn out of cabinet 18. Detent 72 (FIG. 4) is also formed integrally in upper flange 64 to cooperate with roller 50 to properly position drawer box 18 in its closed position. Drawer roller plate 62 is generally L-shaped in cross section including a generally planar body 74, having lower edge 75, and integral securing flange 76 extending generally perpendicularly therefrom. Securing flange 76 abuts lower flange 66 of channel 60 and is welded thereto to rigidly connect the channel and roller bracket 62. Body 74 includes raised circular boss 76 defining an aperture 76*a*. Roller 78 is supported on a rivet secured within aperture 76*a***.

Figure 4A:
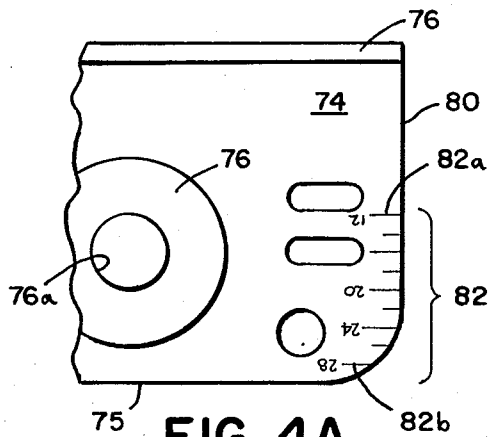
FIG. 4A is an enlarged fragmentary side elevational view of the right drawer channel roller plate and scale thereon.

Drawer roller plate body 74 (FIGS. 4 and 4A) includes generally linear edge 80 extending generally perpendicularly from flange 76. A plurality of marks 82 are scribed into body 74, and more preferably are stamped therein. Uppermost mark **82*a* bears an annotation numeral "12", while lowermost mark 82*b* bears an annotation numeral "28". The annotation numerals indicate that the respective marks are to be utilized in installing channels 60 having the designated lengths in inches. For example, mark 82*a* is used with a 12-inch channel, while mark 82*b* is used with a 28-inch channel. The remaining marks 82 between marks 82*a* and 82*b* correspond to 2-inch increments in the length of channel 60 and more particularly to lengths of 14, 16, 18, 20, 22, 24, and 26 inches. The actual distance between marks 82*a* and 82*b* is one-half inch, and the remainder of marks 82** are spaced evenly therebetween.

Channels 30 and 60, roller brackets 32 and 62, and stop lever 48 are preferably all formed of 1010 cold-rolled steel having a thickness of 0.043 inch. Rollers 50 and 78 are preferably fabricated of a polymeric material such as nylon.

Installation and Operation

Figure 7:
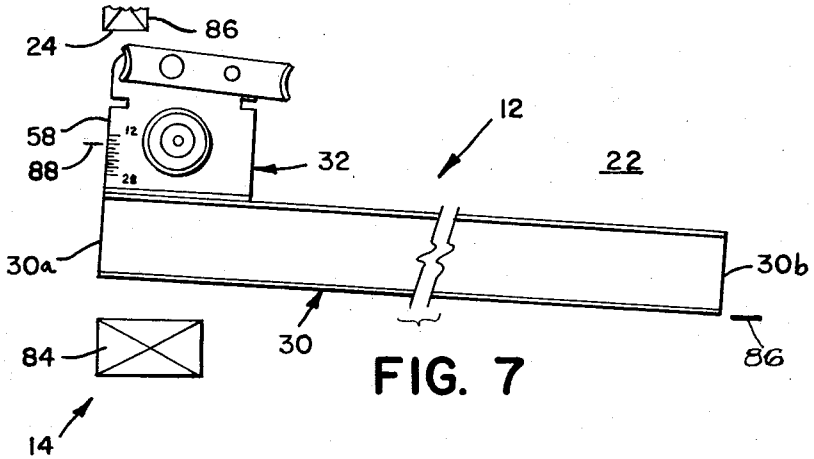
FIG. 7 is a fragmentary side elevational view of the left cabinet channel assembly properly oriented within the cabinet.
Figure 6:
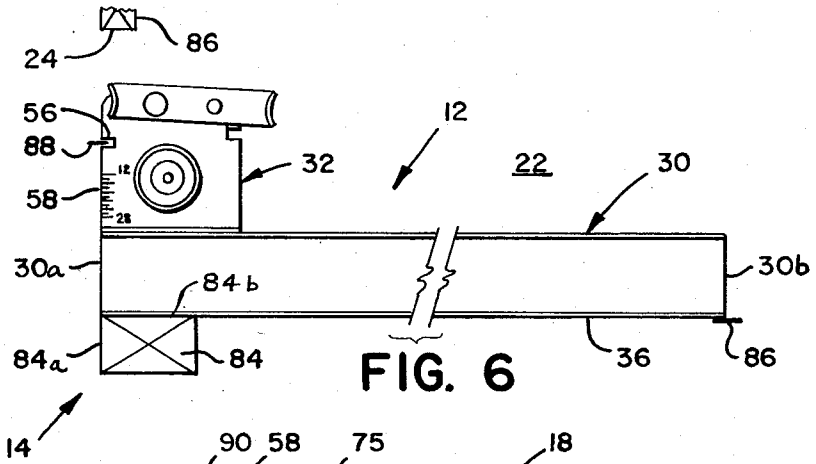
FIG. 6 is a fragmentary side elevational view of the left cabinet channel assembly initially positioned within the cabinet.

The installation of drawer slide 10 to slidably support box 18 within cabinet 14 is illustrated in FIGS. 1 and 6–9. The installation of left cabinet channel assembly 12 is illustrated in FIGS. 6 and 7. Cabinet 14 includes lower and upper members 84 and 86, respectively, defining the lower and upper limits of cabinet opening 24. Channel assembly 12 is initially positioned within cabinet 14 such that forward edge 30*a* is generally vertically aligned with forward edge 84*a* of member 84. Channel 30 is leveled and mark 86 is made at rear end 30*b* even with lower channel flange 36. Mark 86 is therefore level with upper surface 84*b* of member 84 upon which channel 30 rests. Mark 88 is then made on cabinet 14 at notch 56. Forward end 30*a* of channel assembly 12 is raised until the appropriate one of marks 58 is opposite the mark 88 on the cabinet 14. As illustrated in FIGS. 6 and 7, channel 30 has a length of 16 inches such that mark 58 corresponding to annotation numeral "16" is aligned with mark 88. While held in this position, cabinet channel assembly 12 is secured to cabinet 14 using conventional techniques, for example by installing screws through web 38 of the channel. When so installed, cabinet channel assembly 12 is oriented at a desired angle with respect to the horizontal. The installation of the right cabinet channel assembly is performed in a similar manner.

Figure 8:
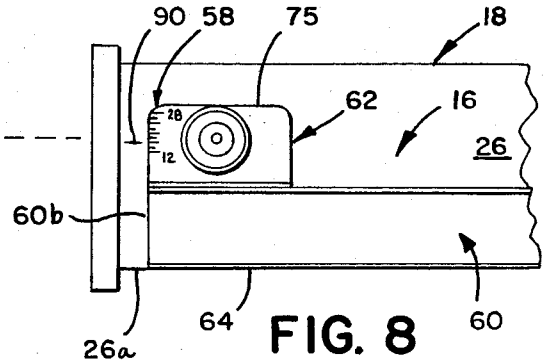
FIG. 8 is a fragmentary side elevational view of the right drawer channel assembly initially positioned against a side of the drawer box.
Figure 9:
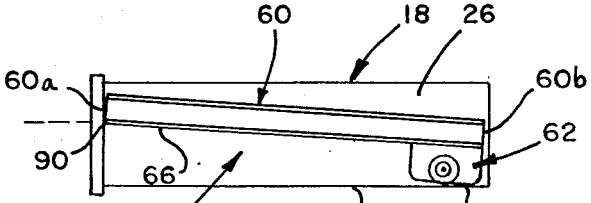
FIG. 9 is a side elevational view showing the drawer channel assembly properly oriented on the side of the drawer box.

A somewhat similar technique is utilized to install right drawer channel assembly 16 on drawer box 18 (FIGS. 8–9). Assembly 16 is initially positioned in an inverted position against drawer box side 26 (FIG. 8) with upper channel flange 64 aligned with lower edge 26*a* of the drawer box side. Mark 90 is made on drawer box side 26 horizontally aligned with the appropriate scale mark 58 corresponding to the length of drawer channel 60. In the embodiment illustrated, drawer channel 60 has a length of 16 inches so that mark 90 is made opposite mark 58 corresponding to a 16-inch channel (see also FIG. 4A). After drawer box 18 has been so marked, channel assembly 16 is inverted and turned end-for-end to its operative position (FIG. 9). Lower flange 66 at forward end 60*a* is aligned with mark 90, while lower edge 75 of roller bracket 62 is aligned with lower edge 26*a* of the drawer box. While held in this position, channel assembly 16 is secured to drawer box 18 in any conventional manner, for example by installing screws through web portion 68. When so installed, drawer channel assembly 16 is oriented at a desired angle inclined from the horizontal, and in the preferred embodiment is inclined at the same angle from the horizontal as drawer channel assembly 12. The installation of the left drawer channel assembly is performed in a similar manner.

Drawer box 18 is inserted into cabinet 14 by interfitting drawer roller 78 within cabinet channel 30 and interfitting cabinet roller 50 with drawer channel 60. The common angle between assemblies 12 and 16 insures that drawer box 18 remains horizontal throughout its movement. The integral scales on assemblies 12 and 16 and the method of installing the assemblies insures that drawer slide 10 is installed rapidly, easily, and accurately. The inclusion of integral scales on assemblies 12 and 16 enables the two channel assemblies 12 and 16 to be installed without the need for separate scales, rulers, tape measures, or instructions indicating various angles of inclination for various slides.

The above description is that of a preferred embodiment of the invention. Various changes and alterations can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A method of installing a self-closing drawer slide comprising:

creating a first scale on a cabinet channel assembly with the first scale being generally perpendicular to the rail of the cabinet channel assembly, the first scale including a plurality of marks each corresponding to a different cabinet rail length;

creating a second scale on a drawer channel assembly with the second scale being generally perpendicular to the rail of the drawer channel assembly, the second scale including a plurality of marks each corresponding to a different rail length;

orienting the cabinet rail generally horizontally with respect to a cabinet on which the cabinet channel assembly is to be mounted;

marking the cabinet at the scale mark corresponding to the length of the cabinet rail;

reorienting the cabinet channel assembly based upon the mark on the cabinet;

securing the cabinet channel assembly to the cabinet;

orienting the drawer rail generally horizontally with respect to a drawer box on which the drawer channel assembly is to be mounted;

marking the drawer box at the scale mark corresponding to the length of the drawer rail;

reorienting the drawer channel assembly based upon the mark on the drawer box; and securing the drawer channel assembly to the drawer box.

2. A method as defined in claim 1 wherein:

said second orienting step comprises positioning the drawer channel assembly roller bracket proximate the forward end of the drawer box; and said second reorienting step comprises turning the drawer channel assembly end for end and positioning the drawer roller bracket proximate the rear end of the drawer box.

3. A method as defined in claim 2 wherein:

said second orienting step comprises aligning the drawer rail with the bottom of the drawer box; and said second reorienting step comprises aligning the drawer roller bracket with the bottom of the drawer box and aligning the drawer rail with the mark on the drawer box.

4. A method as defined in claim 1 wherein said creating steps comprise creating the scales on the roller brackets of the channel assemblies.

5. A method of manufacturing a drawer slide comprising:

creating a first scale on a cabinet channel assembly with the first scale being generally perpendicular to the cabinet channel assembly rail, the first scale including a plurality of marks each corresponding to a different length rail; and creating a second scale on a drawer channel assembly with the second scale being generally perpendicular to the drawer channel assembly rail, the second scale including a plurality of marks each corresponding to a different length rail.

6. A method as defined in claim 5 wherein said creating steps include creating the scales on the channel assembly roller brackets.

7. A method as defined in claim 6 wherein said creating steps further include scribing the scales into the roller brackets.

8. A method as defined in claim 7 wherein said scribing steps further include stamping the scales into the roller brackets.

9. A drawer slide comprising:

a cabinet channel assembly includes a cabinet rail and a first scale generally perpendicular to said cabinet rail, said first scale including a plurality of marks each corresponding to a unique cabinet rail length; and a drawer channel assembly including a drawer rail and a second scale generally perpendicular to said drawer rail, said second scale including a plurality of marks each corresponding to a unique drawer rail length, whereby said cabinet and drawer channel assemblies can be oriented at a common angle by first, horizontally orienting said assemblies, second, marking a cabinet and a drawer box at marks on said first and second scales, respectively, and third, reorienting said assemblies based upon the channel and drawer box marks.

10. A slide as defined in claim 9 wherein said cabinet and drawer channel assemblies each include a roller bracket, and further wherein said first and second scales are scribed into said cabinet and drawer roller brackets, respectively.

11. A slide as defined in claim 10 wherein said first and second scales are stamped into said cabinet and drawer roller brackets, respectively.

12. A self-closing drawer slide comprising:

a cabinet rail having a length and a pair of opposed ends;

a cabinet roller bracket secured to one of said cabinet rail ends;

a cabinet scale on said cabinet roller bracket, said scale being generally perpendicular to said cabinet rail and including a plurality of graduated marks each indicative of a distance corresponding to a different cabinet rail length, whereby said channel scale can be used to mark the forward portion of a cabinet at the distance corresponding to said rail length, and said cabinet rail end can be aligned with the cabinet mark to orient said cabinet rail at a desired inclination;

a drawer rail having said length and a pair of opposed ends;

a drawer roller bracket secured to one of said drawer rail ends; and a drawer scale on said drawer bracket, said drawer scale being generally perpendicular to said drawer rail and including a plurality of graduated marks each indicative of a distance corresponding to a different channel length, whereby said drawer scale can be positioned at the forward end of a drawer box for marking the box at the distance corresponding to said rail length and said drawer rail can be turned end-for-end and inverted to an operative position aligned with the drawer box mark to orient said drawer rail at said desired inclination.

* * * * *

UNITED STATES PATENT AND TRADEMARK OFFICE

CERTIFICATE OF CORRECTION

PATENT NO. : 4,615,095

DATED : October 7, 1986

INVENTOR(S) : Walter L. Bessinger et al.

It is certified that error appears in the above-identified patent and that said Letters Patent is hereby corrected as shown below:

Column 7, Claim 9, line 14, "includes" should read -- including --.

Column 8, Claim 12, line 16, after "said" insert -- one --.

Signed and Sealed this

Twenty-eighth Day of April, 1987

*Attest:*

DONALD J. QUIGG

*Attesting Officer*

*Commissioner of Patents and Trademarks*